US005987849A

United States Patent [19]

Weder

[11] Patent Number: 5,987,849

[45] Date of Patent: Nov. 23, 1999

[54] METHOD FOR PROVIDING A MULTI-LAYERED DECORATIVE COVER FOR A FLOWER POT

[75] Inventor: Donald E. Weder, Highland, Ill.

[73] Assignee: Southpac Trust International, Inc.

[21] Appl. No.: 09/036,059

[22] Filed: Mar. 6, 1998

[51] Int. Cl.[6] ..... A01G 9/02; B65B 25/02

[52] U.S. Cl. ..... 53/397; 53/390; 53/399; 53/449

[58] Field of Search ..... 53/399, 397, 449, 53/390, 414, 410, 464, 461, 138.6, 139.1, 592, 172, 171, 170, 176, 139.4, 219, 218, 221, 220; 206/423; 47/72

[56] References Cited

U.S. PATENT DOCUMENTS 5,526,932 6/1996 Weder ..... 53/449 X
5,551,140 9/1996 Weder et al. ..... 53/397 X
5,595,045 1/1997 Weder et al. ..... 53/397
5,596,862 1/1997 Weder ..... 53/397
5,626,003 5/1997 Weder ..... 53/449 X

*Primary Examiner*—James F. Coan
*Attorney, Agent, or Firm*—Dunlap, Codding & Rogers, P.C.

[57] ABSTRACT

A decorative flower pot cover and method for producing same is disclosed wherein the decorative flower pot cover is provided with a multi-layered upper portion formed of a plurality of sheets of material wherein each sheet of material is provided with an opening therein adapted to receiver a lower potion of a flower pot such that, upon positioning the lower end of the flower pot through the openings in the sheets of material, a portion of the sheets of material are connected to a portion of a sidewall of the flower pot and the sheets of material forming the multi-layered upper portion of the decorative flower pot cover extend substantially independent of one another in an upwardly and outwardly angular direction from the sidewall of the flower pot so that an open upper end of the flower pot remains substantially uncovered by the decorative flower pot cover.

21 Claims, 5 Drawing Sheets

METHOD FOR PROVIDING A MULTI-LAYERED DECORATIVE COVER FOR A FLOWER POT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The present invention relates to decorative covers for flower pots, and more particularly but not by way of limitation, to a multi-layered decorative cover for a flower pot and method for producing same. In one aspect, the present invention relates a decorative cover for a flower pot and method for producing same wherein the decorative cover is provided with a multi-layered upper portion formed of at least two sheets of material and a lower portion formed of at least one sheet of material.

BRIEF SUMMARY OF THE INVENTION

According to the present invention, a multi-layered decorative cover for an upper portion of a flower pot is provided, as well as a method for producing such a multi-layered decorative cover. Broadly, the multi-layered decorative cover is formed of at least two sheets of material wherein each sheet of material is provided with an opening therein such that, upon positioning a lower portion of a flower pot through the openings in the sheets of material and forming the sheets of material about an upper portion of the flower pot, the multi-layered decorative cover is formed about the upper portion of the flower pot. In one aspect, the present invention relates to a decorative cover for a flower pot wherein the decorative cover has a multi-layered upper portion formed of at least two sheets of material and a lower portion formed of at least one sheet of material, the multi-layered upper end portion of the decorative cover extending about the upper end portion of the flower pot such that an open upper end of the flower pot remains substantially uncovered, and the lower portion of the decorative cover extending about a lower portion of the flower pot and at least a lower end portion of the multi-layered upper portion of the decorative cover.

An object of the present invention is to provide an improved decorative cover for a flower pot.

Another object of the present invention, while achieving the before-stated object, is to provide a method of providing multi-layered decorative covers for the flower pots.

Other objects, features and advantages of the present invention will be apparent to those skilled in the art from the following detailed description when read in conjunction with the accompanying drawings and appended claims.

DETAILED DESCRIPTION OF THE INVENTION

Definitions

Figure 1:
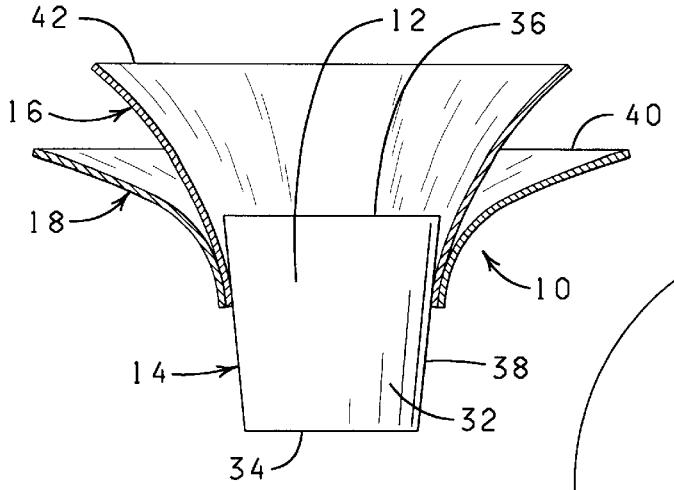
FIG. 1 is a side elevational view, partially in cross section, of a multi-layered flower pot cover constructed in accordance with the present invention wherein the multi-layered flower pot cover is disposed about an upper portion of a flower pot.

The term "flower pot cover", "decorative covering" or "decorative cover" as used herein refers to a cover formed by a plurality of sheets of material wherein at least two sheets of material are disposed about an upper portion of a flower pot. The term "flower pot cover", "decorative covering" or "decorative cover" as used herein also refers to a cover having a multi-layered upper end portion and a lower portion wherein the multi-layered upper end portion of the flower pot cover is disposed about an upper end portion of the flower pot and the lower portion of the flower pot cover is disposed about a lower portion of the flower pot.

The term "pot" or "flower pot" as used herein refers to any container or pot-type container which can be used for holding and/or supporting a floral grouping. Examples of pots and flower pots include, but are not limited to, clay pots, wooden pots, plastic pots, pots made from natural and/or synthetic fibers, or combinations thereof.

The term "floral grouping" as used herein refers to a single flower, foliage, a botanical item, a propagule, cut flowers, artificial flowers, and/or other fresh and/or artificial plants or floral materials, including secondary plants, growing potted plants having a root portion and/or other ornamentation which adds to the aesthetic qualities of the overall floral grouping disposed within a pot or flower pot.

The term "bonding material" as used herein refers to any adhesive or cohesive including pressure sensitive adhesives and co-adhesives. The term "bonding material" as used herein also refers to materials which are heat sealable, sonic sealable, and/or vibratory sealable. For example, the term "bonding material" can refer to a heat sealing lacquer which may be applied to a sheet of material and effectively bonded thereto by heat, sound waves, or vibrations.

The term "bonding material" as used herein also refers to any type of material or device which can be used to effect the bonding or connecting of two adjacent portions of a sheet of material to effect the connection or bonding described herein. Thus, the term "bonding material" can refer to ties, labels, elastomeric bands, ribbons, strings, tape, staples, and combinations thereof.

The term "bonding material" as used herein also refers to any heat or chemically shrinkable material, electrical bonding means such as static electricity, magnetic bonding means, mechanical or barb-type fastening means, clamping means, curl-type characteristics of a film means, materials incorporated into the sheet of material which can cause the sheet of material to take on certain shapes, and any type of welding methods which may weld portions of the sheet to itself and/or other sheets.

The term "polymer film" as used herein refers to a film formed of synthetic polymers such as polypropylene or naturally occurring polymers such as cellophane, which are relatively strong and not subject to tearing (substantially non-tearable). Various types of "polymer films" are described in U.S. Pat. No. 5,311,991, issued to Weder et al. on May 17, 1994 which is hereby incorporated herein by reference.

The terms "cling wrap" or "cling material" as used herein refer to any material which is capable of connecting a sheet of material to itself when such material is wrapped about an item, such as a flower pot or a floral grouping. The terms "cling wrap" or "cling material" are defined in detail in U.S. Pat. No. 5,311,991 issued to Weder et al. on May 17, 1994 which is incorporated herein by reference.

Referring now to the drawings and more particularly to FIG. 1, shown therein is a multi-layered decorative cover 10 disposed about an upper portion 12 of a flower pot 14. The multi-layered decorative cover 10 comprises at least two sheets of material, such as a first or upper sheet of material 16 and a second or lower sheet of material 18. As will be described in more detail herein after, the first and second sheets of material 16 and 18 cooperate to produce the multi-layered decorative cover 10.

Figure 2:
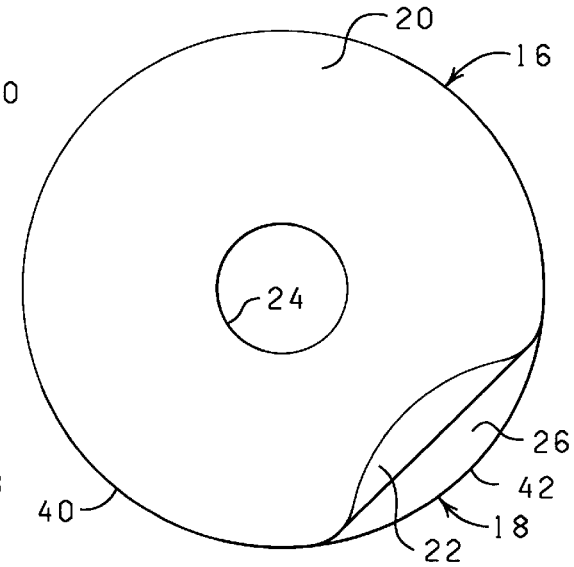
FIG. 2 is a top plan view of two sheets of material having a circular configuration used in the production of the multi-layered flower pot cover of FIG. 1, a portion of the upper sheet of material being turned upwardly to show the lower sheet of material.
Figure 3:
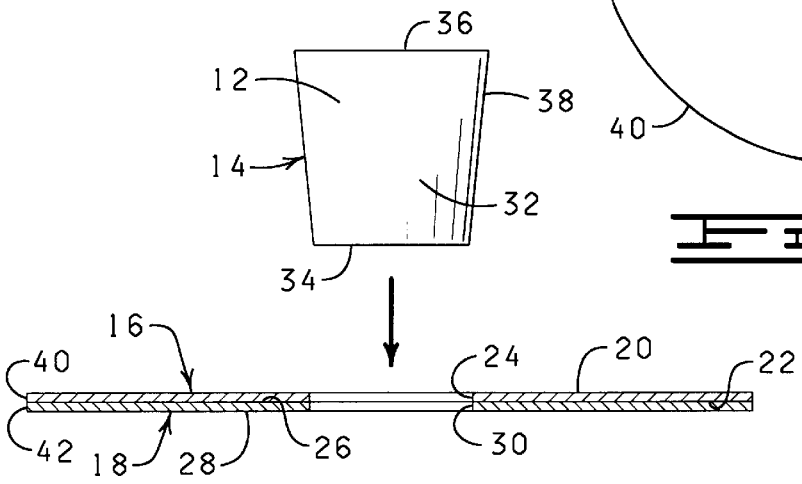
FIG. 3 is a side elevational view, partially in cross section, of the two sheets of material of FIG. 2 having a flower pot positioned above the openings in the sheets of material.

As more clearly shown in FIGS. 2 and 3, the first sheet of material 16 has an upper surface 20, a lower surface 22 and an opening 24 extending through a portion thereof. Similarly, the second sheet of material 18 has an upper surface 26, a lower surface 28 and an opening 30 extending through a portion thereof. The openings 24 and 30 of the first and second sheets of material 16 and 18 are shaped and dimensioned to receive a lower portion 32 of the flower pot 14 so that, upon positioning the lower portion 32 of the flower pot 14 through the openings 24 and 30 in the first and second sheets of material 16 and 18, the first and second sheets of material 16 and 18 can be formed about the upper portion 12 of the flower pot 14 to produce the multi-layered decorative cover 10. It should be noted that the openings 24 and 30 in the first and second sheets of material 16 and 18 can be substantially identical in size as shown in FIG. 3, or the openings 24 and 30 in the first and second sheets of material 16 and 18 may be of different sizes so that the first and second sheets of material 16 and 18 are spatially disposed relative to one another along the upper portion 12 of the flower pot 14.

The first and second sheets of material 16 and 18 have a substantially planar cross-section and a thickness in the range of from about 0.1 mil to about 30 mils, and more desirably from about 1.0 mil to about 10.0 mils. However, it should be understood that the thickness of the first and second sheets of material 16 and 18 may vary depending on the type of material used in the construction of the first and second sheets of material 16 and 18. That is, the first and second sheets of material 16 and 18 can have any thickness so long as the first and second sheets of material 16 and 18 retain sufficient flexibility and foldability so that when the lower portion 32 of the flower pot 14 is disposed in the openings 24 and 30 of the first and second sheets of material 16 and 18, the first and second sheets of material 16 and 18 can be shaped and formed about the upper portion 12 of the flower pot 14 to produce the multi-layered decorative cover 10 for the flower pot 14.

For example, the first and second sheets of material 16 and 18 can be constructed of paper, foil, natural organic polymer films, synthetic organic polymer films, cling wrap, cloth, burlap and/or combinations thereof. The first and second sheets of material 16 and 18 may also be constructed of the same type of material or different types of material and the choice of material for the first and second sheets of material 16 and 18 will depend upon the appearance sought in the multi-layered decorative cover 10.

A decorative pattern, such as a color and/or embossed pattern, a hologram and/or other decorative surface ornamentation may be applied to the upper surfaces 20 and 26 and/or the lower surfaces 22 and 28 of the first and second sheets of material 16 and 18 or portions thereof, including but not limited to printed designs, coatings, colors, flocking or metallic finishes. The first and second sheets of material may be totally or partially clear or tinted transparent material.

Figure 12:
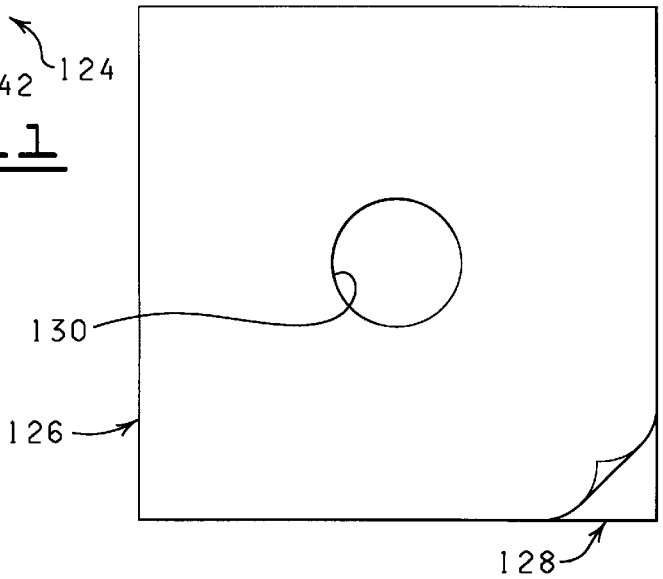
FIG. 12 is a top plan view of two sheets of material having a square configuration used in the production of the multi-layered upper portion of the flower pot cover of FIG. 11, a portion of an upper sheet of material being turned upwardly to show a lower sheet of material.

Although the first and second sheets of material 16 and 18 have been shown in FIGS. 2 and 3 as having a substantially circular configuration, or in FIG. 12 as having a substantially square-shaped configuration, it should be understood that the first and second sheets of material 16 and 18 may have any geometric, non-geometric, asymmetrical or fanciful configuration having any appropriate size so long as the first and second sheets of material 16 and 18 can be provided with their respective openings 24 and 30, and can be disposed about the upper portion 12 of the flower pot 14 to form the multi-layered decorative cover 10 for the flower pot 14.

Referring more specifically to FIGS. 1 and 3, the flower pot 14 has a substantially closed bottom 34, an open upper end 36 and a sidewall 38 extending generally upwardly from a periphery of the substantially closed bottom 34. The substantially closed bottom 34 and the sidewall 38 of the flower pot 14 cooperate to define a receiving space (not shown) for the flower pot 14 which is adapted to receive a floral grouping (not shown). If desired, a drain hole (not shown) can be provided in the substantially closed bottom 34 of the flower pot 14.

To form the decorative covering 10 about the flower pot 14, the lower portion 32 of the flower pot 14 is inserted through the openings 24 and 30 in the first and second sheets of material 16 and 18, respectively, such that a portion of the first sheet of material 16 adjacent the opening 24 of the first sheet of material 16 frictionally engages a portion of the sidewall 38 of the flower pot 14 and a portion of the second sheet of material 18 adjacent the opening 30 of the second sheet of material 18 overlaps and frictionally engages the underlying portion of the first sheet of material 16 to secure the first and second sheets of material 16 and 18 about the flower pot 14. The first and second sheets of material 16 and 18 are then formed about the upper portion 12 of the flower pot 14 to produce the multi-layered decorative cover 10 disposed about the flower pot 14 such that the open upper end 36 of the flower pot 14 remains substantially uncovered by the multi-layered decorative cover 10. To enhance connection of the portions of the first and second sheets of material 16 and 18 adjacent the opening 24 and 30 of the first and second sheets of material 16 and 18 to a portion of the sidewall 38 of the flower pot 14, one can employ an adhesive to bondingly connect the portion of the first sheet of material 16 frictionally engaging the sidewall 38 of the flower pot 14 and an adhesive to bondingly connect the portion of the second sheet of material 18 to the underlying portion of the first sheet of material 16 bondingly connected to the sidewall 38 of the flower pot 14; or one can use any other bonding material, such as an elastic band, a tie, a ribbon and the like, to secure the portion of the first and second sheets of material 16 and 18 adjacent the openings 24 and 30 in the first and second sheets of material 16 and 18 to a portion of the sidewall 38 of the flower pot 14 to the flower pot 14.

When the multi-layered decorative cover 10 is disposed about the flower pot 14, the multi-layered decorative cover 10 extends circumferentially about and substantially encompasses the upper portion 12 of the flower pot 14. In this position, the first sheet of material 16 and the second sheet of material 18 forming the multi-layered decorative cover 10 extend substantially independent of one another in an upwardly and outwardly angular direction from the sidewall 38 of the flower pot 14 so that the open upper end 36 of the flower pot 14 remains substantially uncovered by the multi-layered decorative cover 10.

To assist in the positioning of the first and second sheets of material 16 and 18 about the upper portion 12 of the flower pot 14 to form the multi-layered flower pot cover 10, a portion of the upper surface 26 of the second sheet of material 18 can be adhesively connected to a portion of the lower surface 22 of the first sheet of material 10 by application of a adhesive to the portion of the upper surface 26 of the second sheet of material 18 and/or the lower surface 22 of the first sheet of material 16 adjacent the openings 24 and 30 formed therein. However, when using an adhesive or other bonding material to connect portions of the first and second sheets of material 16 and 18 together adjacent the openings 24 and 30, care must be exercised to insure that a substantial portion of the first and second sheets of material 16 and 18 extending from an outer periphery 40 and 42 of the first and second sheets of material 16 and 18 towards the openings 24 and 30 in the first and second sheets of material 16 and 18, respectively, remains disconnected so that one can manipulate the disconnected portions of the first and second sheets of material 16 and 18 substantially independent of one another in an upwardly and outwardly angular direction from the sidewall 38 of the flower pot 14 to provide a desired appearance for the multi-layered decorative cover 10 while maintaining the open upper end 36 of the flower pot 14 substantially uncovered by the multi-layered decorative cover 10.

Figure 4:
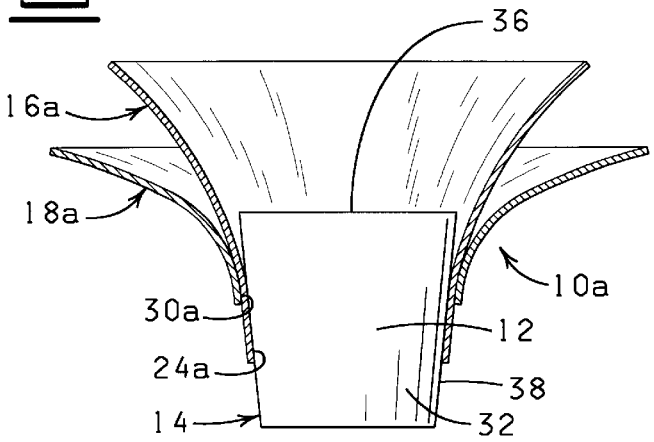
FIG. 4 is a side elevational view, partially in cross section, of another embodiment of a multi-layered flower pot cover constructed in accordance with the present invention wherein the multi-layered flower pot cover is disposed about an upper portion of a flower pot.
Figure 5:
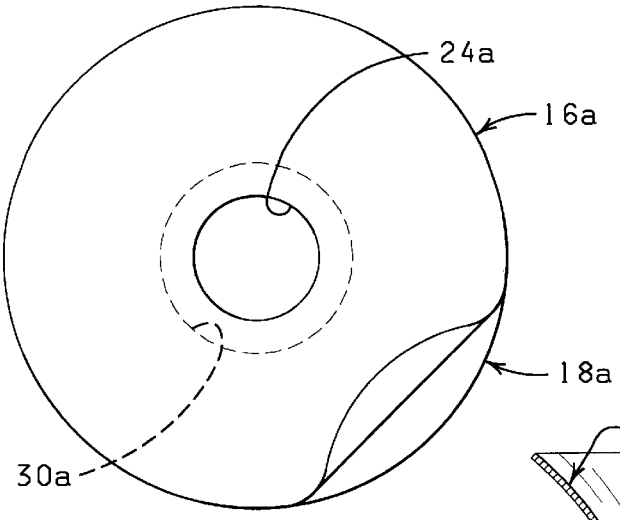
FIG. 5 is a top plan view of two sheets of material having a circular configuration used in the production of the multi-layered flower pot cover of FIG. 4 wherein a portion of an upper sheet is turned upwardly to show a portion of a lower sheet of material.

Referring now to FIG. 4, another embodiment of a multi-layered decorative cover **10*a* is shown disposed about the upper portion 12 of the flower pot 14. The multi-layered decorative cover 10*a* comprises at least two sheets of material, such as a first sheet of material 16*a* and a second sheet of material 18*a* (FIG. 5). The first and second sheets of material 16*a* and 18*a* are provided with openings 24*a* and 30*a*, respectively, and the first and second sheets of material 16*a* and 18*a* are substantially identical in configuration and construction as the first and second sheets of material 16 and 18 hereinbefore described with reference to FIGS. 1–3, except that the opening 30*a* of the second sheet of material 18*a* is larger in diameter than the opening 24*a* of the first sheet of material 16*a***.

To form the multi-layered decorative cover **10*a* about the flower pot 14, the lower end 32 of the flower pot 14 is inserted through the opening 24*a* in the first sheet of material 16*a* such that a portion of the first sheet of material 16*a* adjacent the opening 24*a* of the first sheet of material 16*a* frictionally engages a portion of the sidewall 38 of the flower pot 14 to secure the first sheet of material 16*a* about the flower pot 14. Thereafter, the lower end 32 of the flower pot 14 is inserted through the opening 30*a* in the second sheet of material 18*a* such that a portion of the sheet of material 18*a* adjacent the opening 30*a* of the second sheet of material 18*a* frictionally engages an underlying portion of the first sheet of material 16*a* whereby the second sheet of material 18*a* is secured about the flower pot 14. The first and second sheets of material 16*a* and 18*a* are then formed about the upper end 12 of the flower pot 14 to produce the multilayered decorative cover 10***a* for the flower pot 14. Thus, the first and second sheets of material 16*a* and 18*a* of the multi-layered decorative cover 10*a* are staggered along the sidewall 38 of the flower pot 14 substantially as shown.

To enhance connection of the portion of the first sheet of material 16*a* adjacent the opening 24*a* to the sidewall 38 of the flower pot 14, and to enhance connection of the portion of the second sheet of material 18*a* adjacent the opening 30*a* to the underlying portion of the first sheet of material 16*a*, one can employ an adhesive to bondingly connect the portion of the first sheet of material 16*a* frictionally engaging the sidewall 38 of the flower pot 14 to the flower pot 14; and one can employ an adhesive to bondingly connect the portion of the second sheet of material 18*a* to the underlying portion of the first sheet of material 16*a*. It should be understood that one can use any other bonding material, such as an elastic band, a tie, a ribbon and the like, to bondingly secure the portion of the first sheet of material 16*a* frictionally engaging the sidewall 38 of the flower pot 14 to the flower pot 14 and to bondingly secure the portion of the second sheet of material 18*a* to the underlying portion of the first sheet of material 16*a*.

When the multi-layered decorative cover 10*a* is formed about the flower pot 14, the multi-layered decorative cover 10*a* extends circumferentially about and substantially encompasses at least the upper portion 12 of the flower pot 14. In this position, the first sheet of material 16*a* and the second sheet of material 18*a* forming the multi-layered decorative cover 10*a* extend substantially independent of one another in and upwardly and outwardly angular direction from the sidewall 38 of the flower pot 14 so that the open upper end 36 of the flower pot 14 remains substantially uncovered by the multi-layered decorative cover 10*a*.

Figure 6:
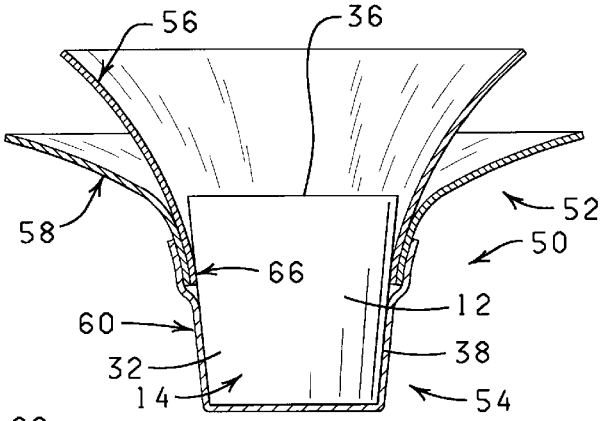
FIG. 6 is a side elevational view, partially in cross section, of another embodiment of a flower pot cover constructed in accordance with the present invention wherein the flower pot cover is provided with a multi-layered upper portion and a lower portion, the multi-layered upper portion of the flower pot cover being disposed about an upper portion of the flower pot and the lower portion of the flower pot cover being disposed about a lower portion of the flower pot and a lower end of the multi-layered upper portion of the flower pot cover.

Referring now to FIG. 6, shown therein is a decorative flower pot cover 50 disposed about of the flower pot 14 having a multi-layered upper portion 52 and lower portion 54. The multi-layered upper portion 52 of the decorative flower pot cover 50 is formed of two or more sheets of material, such as first and second sheets of material 56 and 58. The first and second sheets of material 56 and 58 are substantially identical in construction as the first and second sheets of material 16 and 18 of the multi-layered decorative cover 10 hereinbefore described in detail with reference to FIGS. 1–3. That is, each of the first and second sheets of material 56 and 58 is provided with an opening (not shown) which is shaped and dimensioned to receive the lower portion 32 of the flower pot 14.

To form the multi-layered upper portion 52 of the decorative flower pot cover 50 about the flower pot 14, the lower portion 32 of the flower pot 14 is inserted through the opening (not shown) in the first and second sheets of material 56 and 58 such that a portion of the first sheet of material 56 adjacent the opening of the first sheet of material 56 frictionally engage a portion of the sidewall 38 of the flower pot 14 and a portion of the second sheet of material 58 adjacent the opening in the second sheet of material 58 overlays the portion of the first sheet of material 56 frictionally engaging the sidewall 38 of the flower pot 14. Thus, the first and second sheets of material 56 and 58 are secured about the flower pot 14 in substantially the same manner as the first and second sheets of material 16 and 18 are secured about the flower pot 14. The first and second sheets of material 56 and 58 are then formed about the upper portion 12 of the flower pot 14 to produce the multi-layered upper portion 52 of the decorative flower pot cover 50.

To enhance connection of the portion of the first sheet of material 56 to a portion of the sidewall 38 of the flower pot 14 and a portion of the second sheet of material 58 to the underlying portion of the first sheet of material 56 frictionally engaging the sidewall 38 of the flower pot 14, one can employ an adhesive to bondingly connect the portion of the first sheet of material 56 frictionally engaging the sidewall 38 of the flower pot 14 to the sidewall 38 and an adhesive to bondingly connect the portion of the second sheet of material 58 to the underlying portion of the first sheet of material adhesively connected to a portion of the sidewall 38 of the flower pot 14.

When the multi-layered upper portion 52 of the decorative flower pot cover 50 is disposed about the flower pot 14, the multi-layered upper portion 52 extends circumferentially about and substantially encompasses the upper portion 12 of the sidewall 38 of the flower pot 14. In this position, the first sheet of material 56 and the second sheet of material 58 forming the multi-layered upper portion 52 of the decorative flower pot cover 50 extend substantially independent of one another in and upwardly and outwardly angular direction from the sidewall 38 of the flower pot 14 so that the open upper end 36 of the flower pot 14 remains substantially uncovered by the multi-layered upper portion 52 of the decorative flower pot cover 50.

Figure 7:
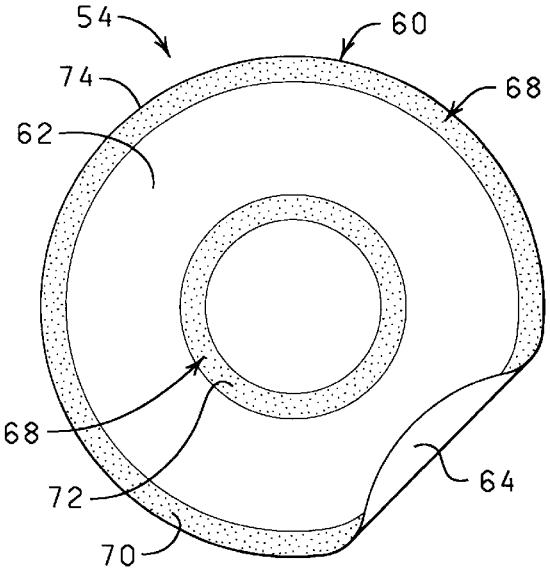
FIG. 7 is a top plan view of a sheet of material used in the construction of the lower portion of the flower pot cover of FIG. 6, a portion of the sheet of material being turned upwardly to show a lower surface of the sheet of material.

Referring now to FIG. 7, shown therein is a sheet of material 60 for forming the lower portion 54 of the decorative flower pot cover 50. The sheet of material 60 has an upper surface 62 and a lower surface 64. To secure the lower portion 54 of the decorative flower pot cover 50 about the lower portion 32 of the flower pot 14 and to a lower end 66 of the multi-layered upper portion 52 of the decorative flower pot cover 50, a bonding material 68 is provided on the upper surface 62 of the sheet of material 60. In the embodiment shown in FIG. 6, the bonding material 68 is shown as two All concentric rings of an adhesive material 70 and 72 wherein the ring of adhesive material 70 is disposed substantially adjacent an outer periphery 174 of the sheet of material 60 and the ring of adhesive material 72 is disposed in a medial portion of the sheet of material 60 substantially as shown. Thus, when the sheet of material 60 is wrapped about the lower portion 32 of the flower pot 14 to form the lower portion 54 of the decorative flower pot cover 50, the lower portion 54 of the decorative flower pot cover 50 is bondingly connected to the flower pot 14 via the ring of adhesive 72 and to the underlying lower end portion 66 of the multi-layered upper portion 52 of the decorative flower pot cover 50 by the ring of adhesive material 70.

Figure 8:
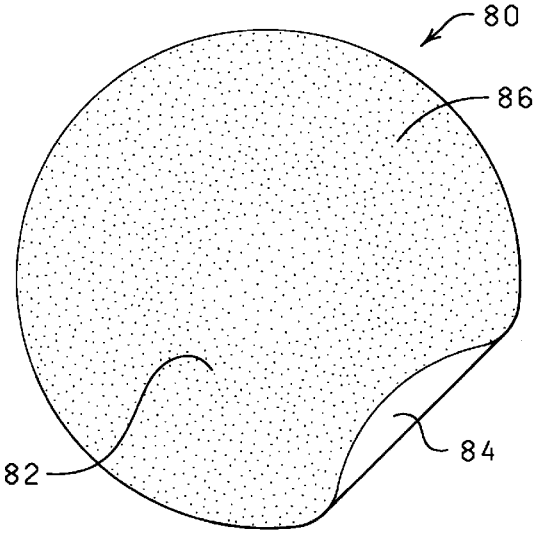
FIG. 8 is a top plan view of another embodiment of a sheet of material used in the construction of the lower portion of the flower pot cover of FIG. 6 a portion of the sheet of material being turned upwardly to show a lower surface of the sheet of material.

Shown in FIG. 8 is another embodiment of a sheet of material 80 for forming the lower portion 54 of the decorative flower pot cover 50. The sheet of material 80 has an upper surface 82 and a lower surface 84. To secure the lower portion 54 of the decorative flower pot cover 50 about the lower portion 32 of the flower pot 14 and to the lower end portion 66 of the multi-layered upper portion 52 of the decorative flower pot cover 50, a bonding material 86 is provided on the upper surface 82 of the sheet of material 80.

In the embodiment shown in FIG. 8, the bonding material 86 is shown as being applied over the entire upper surface 82 of the sheet of material 80. However, it should be understood that the bonding material 86 can be applied in any pattern, such as a plurality of dots, strips, squares and the like. Thus, when the sheet of material 80 is wrapped about the lower portion 32 of the flower pot 14 to form the lower portion 54 of the decorative flower pot cover 50, the lower portion 54 of the decorative flower pot cover 50 is bondingly connected to the flower pot 14 via a portion of the bonding material 86 and to the underlying lower end 66 of the multi-layered upper portion 52 of the decorative flower pot cover 50 by a portion of the bonding material 86.

Although the sheets of material 60 and 80 which can be used to form the lower portion 52 of the decorative cover 50 have been shown in FIGS. 7 and 8 as having a substantially circular configuration, it should be understood that the sheets of material 60 and 80 may have any geometric, non-geometric, asymmetrical or fanciful configuration having any appropriate size so long as the sheets of material 60 and 80 can be wrapped or folded about the lower portion 32 of the flower pot 14 and the lower end 66 of the multi-layered upper portion 52 of the decorative flower pot cover 50 substantially as shown in FIG. 6.

The sheets of material 60 and 80 each have a substantially planar cross-section and a thickness in the range of from about 0.1 mil to about 30 mils, and more desirably from about 1.0 mil to about 10.0 mils. However, it should be understood that the thickness of the sheets of material 60 and 80 may vary depending on the type of material used in the construction of the sheets of material 60 and 80 That is, the sheets of material 60 and 80 can have any thickness so long as the sheets of material 60 and 80 retain sufficient flexibility and foldability so that the sheets of material 60 and 80 can be wrapped or folded about the lower portion 32 of the flower pot 14 and the lower end 66 of the multi-layered upper portion 52 of the decorative flower pot cover 50 substantially as shown in FIG. 6.

For example, the sheets of material 60 and 80 can be constructed of paper, foil, natural polymeric films, synthetic polymeric films, cling wrap, cloth, burlap and/or combinations thereof. The sheets of material 60 and 80 may also be constructed of the same type of material or different types of material as the first sheet of material 56 and the second sheet of material 58 forming the multi-layered upper portion 52 of the decorative flower pot cover 50; and the choice of material for the sheets of material 60 and 80 will depend upon the appearance sought in the decorative flower pot cover 50.

A decorative pattern, such as a color and/or embossed pattern, a hologram and/or other decorative surface ornamentation may be applied to the sheets of material 60 and 80 or portions thereof, including but not limited to printed designs, coatings, colors, flocking or metallic finishes. The sheets of material 60 and 80 may be totally or partially clear or tinted transparent material.

Figure 9:
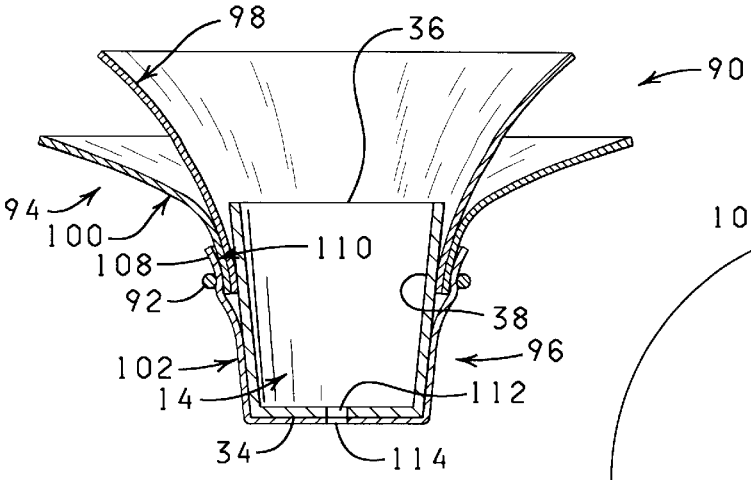
FIG. 9 is a side elevational view, partially in cross section, of another embodiment of a flower pot cover having the multilayered upper portion formed from the sheets of material shown in FIG. 3 and a lower portion formed from the sheet of material of wherein the lower portion of the flower pot cover is disposed about a lower portion of the flower pot and a lower end of the multilayered upper portion of the flower pot cover and secured thereto by a band.

Referring now to FIG. 9, shown therein is another embodiment of a decorative flower pot cover 90 constructed in accordance with the present invention. The decorative flower pot cover 90 is secured about the flower pot 14 by an elastic band 92. While the decorative flower pot cover 90 is shown secured about the flower pot 14 by the elastic band 92, it should be understood that other tying devices, such as string, wire, ribbon and the like can be employed to secure the decorative flower pot cover 90 about the flower pot 14.

The decorative flower pot cover 90 is provided with a multi-layered upper portion 94 and lower portion 96. The multi-layered upper portion 94 of the decorative flower pot cover 90 is formed of two or more sheets of material, such as first and second sheets of material 98 and 100. The first and second sheets of material 98 and 100 are substantially identical in construction as the first and second sheets of material 16 and 18 of the multi-layered decorative cover 10 hereinbefore described in detail with reference to FIGS. 1–3. That is, each of the first and second sheets of material 98 and 100 is provided with an opening (not shown) which is shaped and dimensioned to receive the lower portion 32 of the flower pot 14.

To form the multi-layered upper portion 94 of the decorative flower pot cover 90 about the flower pot 18, the lower portion 32 of the flower pot 14 is inserted through the openings (not shown) in the first and second sheets of material 98 and 100 whereby a portion of the first sheet of material 98 adjacent the opening of the first sheet of material 98 frictionally engage a portion of the sidewall 38 of the flower pot 14 and a portion of the second sheet of material 100 adjacent the opening in the second sheet of material 100 overlays the portion of the first sheet of material 98 frictionally engaging the sidewall 38 of the flower pot 14. Thus, the first and second sheets of material 98 and 100 are disposed about the flower pot 14 in substantially the same manner as the first and second sheets of material 16 and 18 are disposed about the flower pot 14. The first and second sheets of material 98 and 100 are then formed about the upper portion 12 of the flower pot 14 to produce the multi-layered upper portion 94 of the decorative flower pot cover 90.

When the multi-layered upper portion 94 of the decorative flower pot cover 90 is disposed about the flower pot 14, the multi-layered upper portion 94 extends circumferentially about and substantially encompasses the upper portion 12 of the sidewall 38 of the flower pot 14. In this position, the first sheet of material 98 and the second sheet of material 100 forming the multi-layered upper portion 94 of the decorative flower pot cover 90 extend substantially independent of one another in and upwardly and outwardly angular direction from the sidewall 38 of the flower pot 14 so that the open upper end 36 of the flower pot 14 remains substantially uncovered by the multi-layered upper portion 94 of the decorative flower pot cover 90.

Figure 10:
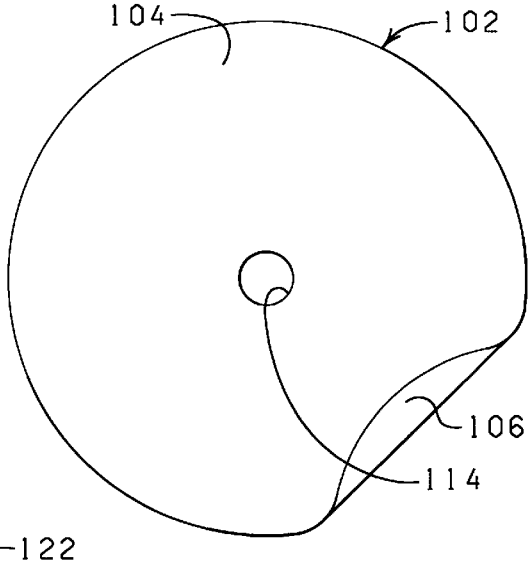
FIG. 10 is a top plan view of yet another embodiment of a sheet of material having a drain hole used in the construction of the lower portion of the flower pot cover of FIG. 9.

Referring now to FIG. 10, shown therein is a sheet of material 102 for forming the lower portion 96 of the decorative flower pot cover 90. The sheet of material 102 has an upper surface 104 and a lower surface 106. The sheet of material 102 is wrapped about the lower portion 32 of the flower pot 14 such that an upper end 108 of the lower portion 96 of the decorative flower pot cover 90 overlays a lower end 110 of the multi-layered upper portion 94 of the decorative flower pot cover 90 (FIG. 9). The lower portion 96 of the decorative flower pot cover 90 is then secured about the lower portion 32 of the flower pot 14 and about the lower end 110 of the multi-layered upper portion 94 of the decorative flower pot cover 90 by the band 92.

The flower pot 14 shown in FIG. 9 is provided with a drain hole 112 in the substantially closed bottom 34 for permitting water to drain from soil or other potting media disposed within the flower pot 18. To provide substantially unrestricted flow of water through the drain hole 112, the sheet of material 102 is provided with an opening 114 therein such that when the sheet of material 102 is wrapped or formed about the lower portion 32 of the flower pot 14, the opening 114 in the sheet of material 102 is aligned with the drain hole 112 in the closed bottom 34 of the flower pot 14 substantially as shown.

Figure 11:
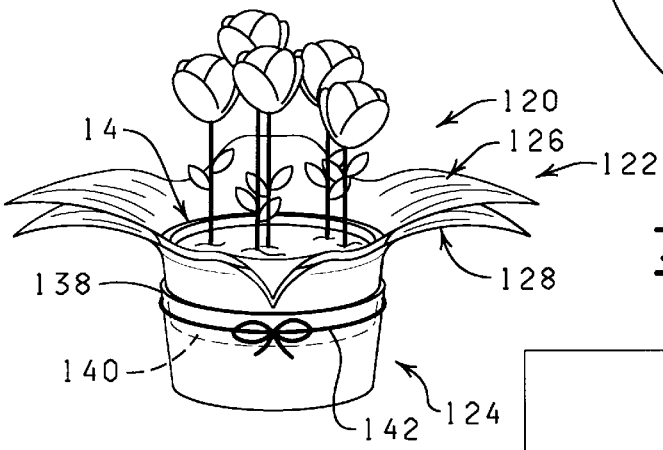
FIG. 11 is a perspective view of the flower pot having another embodiment of a flower pot cover constructed in accordance with the present invention disposed about the flower pot, the flower pot cover having a multi-layered upper portion formed from two sheets of material and a lower portion formed from one sheet of material.

Referring now to FIGS. 11 and 12, shown therein is the flower pot 14 having another embodiment of a decorative flower pot cover 120 formed thereabout. The decorative flower pot cover 120 is provided with a multi-layered upper portion 122 and a lower portion 124. The multi-layered upper portion 122 is formed of a plurality of sheets of material, such as a first sheet of material 126 and a second sheet of material 128. The first sheet of material 126 has a substantially square-shaped configuration and has an opening 130 extending therethrough (FIG. 12). Similarly, the second sheet of material 128 has a substantially square-shaped configuration and has an opening (not shown) extending there-through. With the exception of the substantially square-shaped configuration, the first and second sheets of material 126 and 128 are substantially identical in construction to the first and second sheets of material 16 and 18 of the multi-layered decorative flower pot cover 10 hereinbefore described in detail with reference to FIGS. 1–3. That is, the opening 130 in the first sheet of material 126 and the opening (not shown) in the second sheet of material 128 are shaped and dimensioned to receive the lower portion 32 of the flower pot 14. Thus, the first sheet of material 126 and the second sheet of material 128, which extend substantially independent of one another, can be formed into the multi-layered upper portion 122 of the decorative flower pot cover 120 which extends in an upwardly and outwardly angular direction from the sidewall (not show) of the flower pot 14 substantially as shown.

To form the multi-layered upper portion 122 of the decorative flower pot cover 120 about the flower pot 14, the lower portion 32 of the flower pot 14 is inserted through the opening 130 in the first sheet of material 126 and the opening (not shown) in the second sheet of material 128 such that a portion of the first sheet of material 126 adjacent the opening 130 of the first sheet of material 126 frictionally engages a portion of the sidewall (not shown) of the flower pot 14, and a portion of the second sheet of material 128 adjacent the opening (not shown) in the second sheet of material 128 overlays the portion of the first sheet of material 126 frictionally engaging the sidewall of the flower pot 14.

To enhance connection of the portion of the first sheet of material 126 to a portion of the sidewall of the flower pot 14 and a portion of the second sheet of material 128 to the underlying portion of the first sheet of material 126 frictionally engaging the sidewall of the flower pot 14, one can employ an adhesive to bondingly connect the portion of the first sheet of material 126 frictionally engaging the sidewall of the flower pot 14 to the sidewall and an adhesive to bondingly connect the portion of the second sheet of material 128 to the underlying portion of the first sheet of material 126 adhesively connected to a portion of the sidewall of the flower pot 14 in the same manner the multi-layered upper portion 52 of the decorative flower pot cover 50 is connected to the sidewall 38 of the flower pot 14 hereinbefore described with reference FIG. 6.

Figure 13:
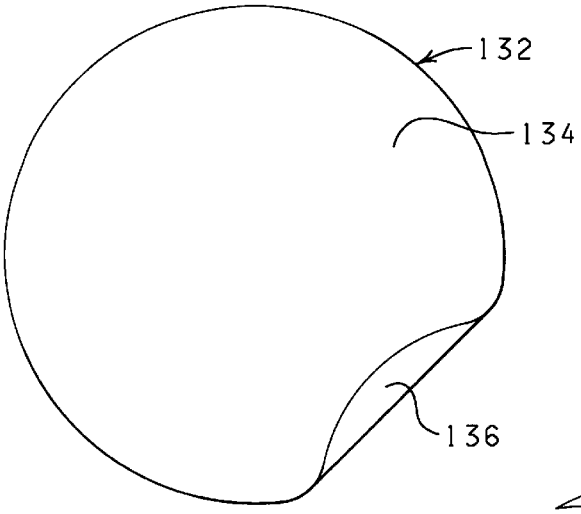
FIG. 13 is a top plan view of a sheet of material used in the construction of the lower portion of the flower pot cover of FIG. 11.

Referring now to FIG. 13, shown therein is a sheet of material 132 for forming the lower portion 124 of the decorative flower pot cover 120. The sheet of material 132 has an upper surface 134 and a lower surface 136. The sheet of material 132 is wrapped about the lower portion 32 of the flower pot 14 (FIG. 11) such that an upper end 138 of the lower portion 124 of the decorative flower pot cover 120 overlays a lower end 140 of the multi-layered upper portion 122 of the decorative flower pot cover 120. The lower portion 124 of the decorative flower pot cover 120 is then secured about the lower portion (not shown) of the flower pot 14 and about the lower end 140 of the multi-layered upper portion 122 of the decorative flower pot cover 120 by a ribbon 142. It should be noted that while the lower portion 124 of the decorative flower pot cover 120 is shown as being secured about the lower portion 32 of the flower pot 14 and about the lower end 140 of the multi-layered upper portion 122 of the decorative flower pot cover 120 by the ribbon 142, any other suitable bonding material including, but not limited to, adhesives, bands, ties and the like may be used to secure the lower portion 124 of the decorative flower pot cover 120 about the lower portion (not shown) of the flower pot 14 and about the lower end 140 of the multi-layered upper portion 122 of the decorative flower pot cover 120.

The multi-layered upper portion 122 of the decorative flower pot cover 120 will be provided with a four-corner configuration substantially as shown in FIG. 11 when the first and second sheets of material 126 and 128 have a substantially square-shaped configuration and when the first sheet of material 126 is positioned on the second sheet of material 128 such that the edges of the first and second sheets of material 126 and 128 are aligned substantially as shown in FIG. 11. However, it should be noted that a different appearance can be achieved in the multi-layered upper portion 122 of the decorative flower pot cover 120 when the second sheet of material 128 is rotated relative to the first sheet of material 126 or vice versa.

Figure 14:
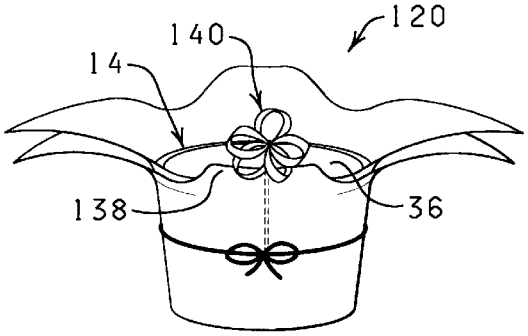
FIG. 14 is a perspective view of the flower pot having the flower pot cover of FIG. 11 formed thereabout wherein a portion of the multi-layered upper portion of the flower pot cover is folded inwardly into an open upper end of the flower pot.

In addition, the decorative flower pot cover 120 can be provided with a different overall appearance by folding a portion 138 of the multi-layered upper portion 122 of the decorative flower pot cover inwardly into the open upper end 36 of the flower pot 14 substantially as shown in FIG. 14. If desired, decorative accessories, such as additional bows, decorative grass, or place cards having decorative indicia thereon and generally represented by the numeral 140 can be positioned in the open upper end 36 of the flower pot 14 so as to be viewable through the opening in the multi-layered upper portion 122 of the decorative flower pot cover 120.

While the multi-layered upper portions of the decorative flower pot covers hereinbefore described have been formed of a plurality of sheets of material having the same overall configuration and dimensions, it should be understood that the sheets of material employed to form the multi-layered upper portion of the decorative flower pot covers of the present invention may have various configurations and dimensions depending on the overall appearance desired for the decorative flower pot cover.

Figure 15:
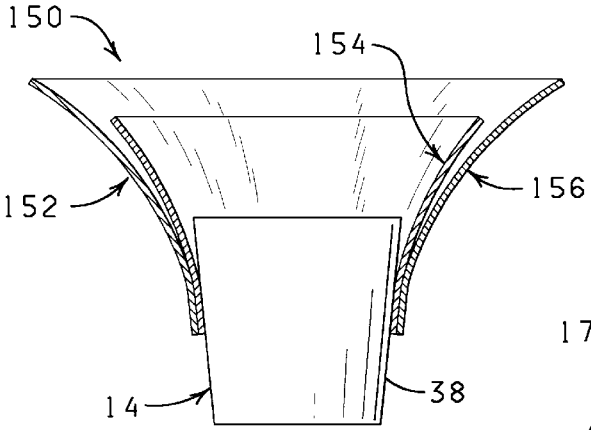
FIG. 15 is a side elevational view, partially in cross section, of another embodiment of a multi-layered flower pot cover constructed in accordance with the present invention wherein the multi-layered flower pot cover is disposed about an upper portion of a flower pot.
Figure 16:
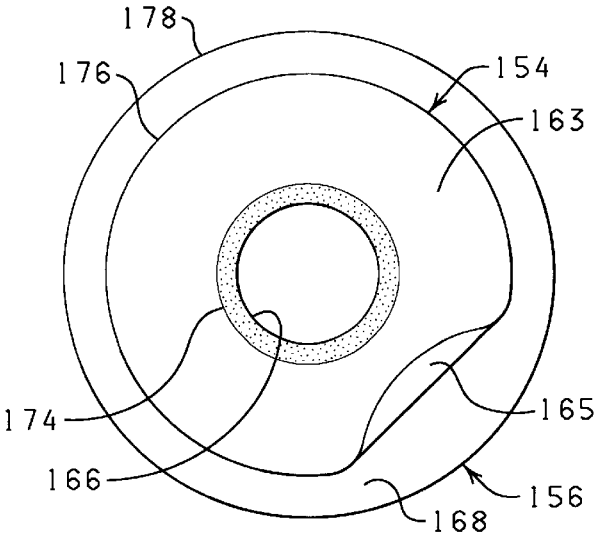
FIG. 16 is a top plan view of two sheets of material having a circular configuration used in the production of the multi-layered flower pot cover of FIG. 15, a portion of the sheet of material being turned upwardly to show a lower sheet of material.
Figure 17:
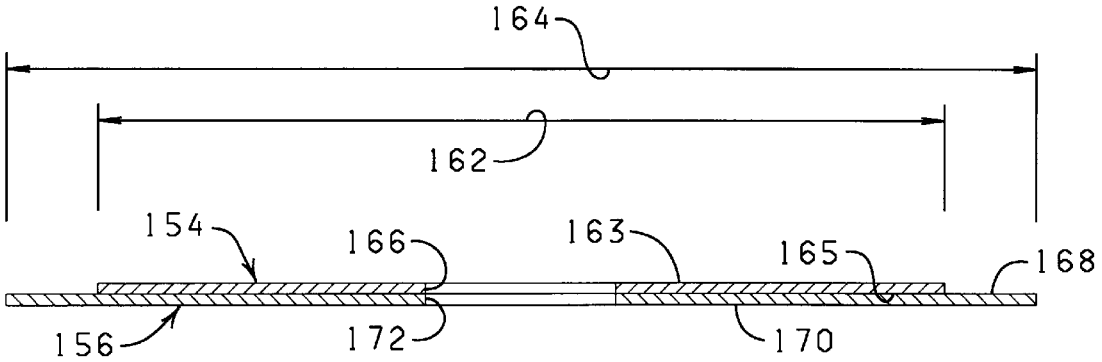
FIG. 17 is a side elevational view, partially in cross section, of the two sheets of material of FIG. 16 used in the production of the multi-layered flower pot cover of FIG. 15.

Referring now to FIG. 15, another embodiment of a flower pot cover 150 is illustrated disposed about the flower pot 14. The decorative flower pot cover 150 is provided with a multi-layered upper portion 152 formed of a plurality of sheets of material, such as a first sheet of material 154 and a second sheet of material 156 (FIGS. 16 and 17). The first and second sheets of material 154 and 156 are illustrated as having a generally circular configuration and the first sheet of material 154 has a diameter 162 which is less than a diameter 164 of the second sheet of material 156 (FIGS. 16 and 17). Thus, the second sheet of material 156 is larger in size than the first sheet of material 154.

As more clearly shown in FIGS. 16 and 17, the first sheet of material 154 has an upper surface 163, a lower surface 165 and an opening 166 extending through a portion thereof. Similarly, the second sheet of material 156 has an upper surface 168, a lower surface 170 and an opening 172 extending through a portion thereof. The openings 166 and 172 of the first and second sheets of material 154 and 156 are shaped and dimensioned to receive the lower portion 32 of the flower pot 14 so that, upon positioning the lower portion 32 of the flower pot 14 through the openings 166 and 172 in the first and second sheets of material 154 and 156, the first and second sheets of material 154 and 156 can be formed about the upper portion 12 of the flower pot 14 to produce the decorative flower pot cover 150. It should be noted that the openings 166 and 172 in the first and second sheets of material 154 and 156 can be substantially identical in size as shown in FIG. 17, or the openings 166 and 172 in the first and second sheets of material 154 and 156 may be of different sizes so that the first and second sheets of material 154 and 156 are spatially disposed relative to one another along the upper portion 12 of the flower pot 14.

To secure the portion of the first sheet of material 154 frictionally engaging a portion of the sidewall 38 of the flower pot 14 to the flower pot 14, the first sheet of material 154 may be provided with a bonding material disposed on a portion of the upper surface 163 of the first sheet of material 154 substantially adjacent the opening 166 in the first sheet of material 154, such as a ring of adhesive 174. Similarly, to secure the second sheet of material 156 to the underlying portion of the first sheet of material 154 frictionally engaging a portion of the sidewall 38 of the flower pot 14, the second sheet of material 156 may be provided with a bonding material (not shown) disposed on a portion of the upper surface 168 of the second sheet of material 156 substantially adjacent the opening 172 in the second sheet of material 156. When using a bonding material to connect a portion of the first sheet of material 154 to a portion of the sidewall 38 of the flower pot 14 and a portion of the second sheet of material 156 to an underlying portion of the first sheet of material 154, care must be exercised to insure that a substantial portion of the first and second sheets of material 154 and 156 extending from an outer periphery 176 and 178, respectively, of the first and second sheets of material 154 and 156 towards the openings 166 and 172 in the first and second sheets of material 154 and 156, respectively, remains disconnected so that one can manipulate the disconnected portions of the first and second sheets of material 154 and 156 substantially independent of one another in an upwardly and outwardly angular direction from the sidewall 38 of the flower pot 14 to provide a desired appearance for the multi-layered upper portion 152 of the decorative flower pot cover 150 while maintaining the open upper end 36 of the flower pot 14 substantially uncovered by the multi-layered upper portion 152 of the decorative flower pot cover 150.

With the exception noted above, the first and second sheets of material 154 and 156 are substantially identical in construction as the first and second sheets of material 16 and 18 hereinbefore described with reference to FIGS. 1–3. That is, the first and second sheets of material 154 and 156 can have any thickness and be formed of any material as long as the first and second sheets of material 154 and 156 retain sufficient flexibility and foldability so that when the lower portion 32 of the flower pot 14 is disposed in the openings 166 and 172 of the first and second sheets of material 154 and 156, the first and second sheets of material 154 and 156 can be shaped and formed about the upper portion 12 of the flower pot 14 to produce the multi-layered upper portion 152 of the decorative flower pot cover 150.

Although the first and second sheets of material 154 and 156 has been shown as having a substantially circular configuration, it should be understood that the first and second sheets of material 154 and 156 may have any geometric, non-geometric, asymmetrical or fanciful configuration having any appropriate size so long as the first and second sheets of material 154 and 156 can be provided with their respective openings 166 and 172, and can be disposed about the upper portion 12 of the flower pot 14 to form the multi-layered upper portion 152 of the decorative flower pot cover 150

To form the decorative flower pot cover 150 about the flower pot 14, the lower portion 32 of the flower pot 14 is inserted through the openings 166 and 172 in the first and second sheets of material 154 and 156, respectively, such that a portion of the first sheet of material 154 adjacent the opening 166 of the first sheet of material 154 frictionally engages and is adhesively connected to a portion of the sidewall 38 of the flower pot 14, and a portion of the second sheet of material 156 adjacent the opening 172 of the second sheet of material 156 overlaps and is adhesively bonded to the underlying portion of the first sheet of material 154 to secure the first and second sheets of material 154 and 156 about the flower pot 14. The first and second sheets of material 154 and 156 are then formed about the upper portion 12 of the flower pot 14 to produce the multi-layered upper portion 152 of the decorative flower pot cover 150 disposed about the flower pot 14 such that the open upper end 36 of the flower pot 14 remains substantially uncovered by the decorative flower pot cover 150.

When the decorative flower pot cover 150 is disposed about the flower pot 14, the multi-layered upper portion 152 of the decorative flower pot cover 150 extends circumferentially about and substantially encompasses the upper portion 12 of the flower pot 14. In this position, the first sheet of material 154 and the second sheet of material 156 forming the multi-layered upper portion 152 of the decorative flower pot cover 150 extend substantially independent of one another in an upwardly and outwardly angular direction from the sidewall 38 of the flower pot 14 so that the open upper end 36 of the flower pot 14 remains substantially uncovered by the decorative flower pot cover 150.

While certain embodiments of a decorative flower pot cover having a multi-layered upper portion have been described in detail herein, it should be understood that changes may be made in the construction and operation of the various components and assemblies described herein and changes may be made in the steps or the sequence of steps of the methods described herein without departing from the spirit and the scope of the invention as defined in the following claims.

What is claimed is:

1. A method for providing a decorative cover for a flower pot, comprising:

providing a flower pot having an upper portion, a lower portion and an open upper end;

providing at least a first sheet of material and a second sheet of material, each of the first and second sheets of material having an opening therein adapted to receive the lower portion of the flower pot;

inserting the lower end portion of the flower pot through the openings in the first and second sheets of material such that a portion of the first sheet of material surrounding the opening in the first sheet of material disposed adjacent the flower pot is connected to an adjacent portion of the flower pot and a portion of the second sheet of material surrounding the opening in the second sheet of material is connected to an underlying portion of the first sheet of material; and forming the first and second sheets of material about the upper portion of the flower pot independently of one another to form a multi-layered decorative cover wherein the first and second sheets of material extend upwardly and outwardly from the upper portion of the flower pot in different directions while the open upper end of the flower pot remains substantially uncovered by the multi-layered decorative cover.

2. A method for providing a decorative cover for a flower pot of claim 1 wherein the portion of the first sheet surrounding the opening in the first sheet of material disposed adjacent the flower pot is frictionally connected to the adjacent portion of the flower pot and the portion of the second sheet of material surrounding the opening in the second sheet of material is frictionally connected to the underlying portion of the first sheet of material.

3. The method for providing a decorative cover for a flower pot of claim 1 wherein the first sheet of material is provided with an upper surface, a lower surface and an adhesive material disposed on a portion of the upper surface of the first sheet of material substantially adjacent the opening in the first sheet of material for bondingly connecting the portion of the first sheet of material to the flower pot.

4. The method for providing a decorative cover for a flower pot of claim 3 wherein the second sheet of material is provided with an upper surface, a lower surface and an adhesive material disposed on a portion of the upper surface of the second sheet of material substantially adjacent the opening in the second sheet of material for bondingly connecting the portion of the second sheet of material to the underlying portion of the first sheet of material.

5. The method for providing a decorative cover for a flower pot of claim 1 wherein the second sheet of material is provided with an upper surface, a lower surface and an adhesive material disposed on a portion of the upper surface of the second sheet of material substantially adjacent the opening in the second sheet of material for bondingly connecting the portion of the second sheet of material to the underlying portion of the first sheet of material.

6. The method for providing a decorative cover for a flower pot of claim 1 further comprising:

positioning a band about a portion of the multi-layered decorative cover for securing the multi-layered decorative cover to the upper portion of the flower pot.

7. The method for providing a decorative cover for a flower pot of claim 1 wherein the openings in the first and second sheets of material substantially correspond in size.

8. The method for providing a decorative cover for a flower pot of claim 1 wherein the opening in the second sheet of material has a diameter greater than the opening in the first sheet of material.

9. A method for providing a decorative cover for a flower pot, comprising:

providing a flower pot having an upper portion, a lower portion and an open upper end;

providing at least a first sheet of material and a second sheet of material to form a multi-layered upper portion of the decorative cover, each of the first and second sheets of material having an opening therein adapted to receive the lower portion of the flower pot;

inserting the lower end portion of the flower pot through the openings in the first and second sheets of material such that a portion of the first sheet of material surrounding the opening in the first sheet of material disposed adjacent the flower pot is connected to an adjacent portion of the flower pot and a portion of the second sheet of material surrounding the opening in the second sheet of material is connected to an underlying portion of the first sheet of material;

forming the first and second sheets of material about the upper portion of the flower pot independently of one another to form a multi-layered decorative cover wherein the first and second sheets of material extend upwardly and outwardly from the upper portion of the flower pot in different directions while the open upper end of the flower pot remains substantially uncovered by the multi-layered decorative cover; and providing at least one sheet of material to form a lower portion of the decorative cover, the sheet of material being disposed about the lower portion of the flower pot such that an upper end of the lower portion of the decorative cover overlaps a lower end of the multi-layered upper portion of the decorative cover.

10. A method for providing a decorative cover for a flower pot of claim 9 wherein the portion of the first sheet of material surrounding the opening in the first sheet of material disposed adjacent the flower pot is frictionally connected to the adjacent portion of the flower pot and the portion of the second sheet of material surrounding the opening in the second sheet of material is frictionally connected to the underlying portion of the first sheet of material.

11. A method for providing a decorative cover for a flower pot of claim 10 wherein the sheet of material of the lower portion of the decorative cover has a thickness in the range of from about 0.1 mil to about 30 mils.

12. A method for providing a decorative cover for a flower pot of claim 9 wherein the sheet of material of the lower portion of the decorative cover has a thickness in the range of from about 0.1 mil to about 30 mils.

13. The method for providing a decorative cover for a flower pot of claim 9 wherein the first sheet of material of the multi-layered upper portion of the decorative cover is provided with an upper surface, a lower surface and an adhesive material disposed on a portion of the upper surface substantially adjacent the opening therein for bondingly connecting the portion of the first sheet of material of the multi-layered upper portion of the decorative cover to the flower pot.

14. The method for providing a decorative cover for a flower pot of claim 13 wherein the second sheet of material of the multi-layered upper portion of the decorative cover is provided with an upper surface, a lower surface and an adhesive material disposed on a portion of the upper surface substantially adjacent the opening in the second sheet of material for bondingly connecting the portion of the second sheet of material of the multi-layered decorative cover to the underlying portion of the first sheet of material of the multi-layered decorative cover.

15. The method for providing a decorative cover for a flower pot of claim 9 wherein the second sheet of material of the multi-layered upper portion of the decorative cover is provided with an upper surface, a lower surface and an adhesive material disposed on a portion of the upper surface substantially adjacent the opening in the second sheet of material for bondingly connecting the portion of the second sheet of material of the multi-layered decorative cover to the underlying portion of the first sheet of material of the multi-layered decorative cover.

16. The method for providing a decorative cover for a flower pot of claim 9 further comprising:

positioning a band about the lower portion and the overlapped lower end of the multi-layered decorative cover for securing the lower portion and the multi-layered upper portion of the decorative cover to the flower pot.

17. The method for providing a decorative cover for a flower pot of claim 9 wherein the openings in the first and second sheets of material of the multi-layered upper portion of the decororative cover substantially correspond in size.

18. The method for providing a decorative cover for a flower pot of claim 9 wherein the opening in the second sheet of material of the multi-layered upper portion of the decorative cover has a diameter greater than the opening in the first sheet of material of the multi-layered portion of the decorative cover.

19. The method for providing a decorative cover for a flower pot of claim 18 further comprising:

positioning a band about the lower portion and the overlapped lower end of the multi-layered decorative cover for securing the lower portion and the multi-layered upper portion of the decorative cover to the flower pot.

20. The method for providing a decorative cover for a flower pot of claim 19 further comprising:

positioning a bow about the decorative cover.

21. The method for providing a decorative cover for a flower pot of claim 9 further comprising:

securing a bow about the decorative cover for securing the lower portion and the multi-layered upper portion of the decorative cover about the flower pot.

* * * * *

UNITED STATES PATENT AND TRADEMARK OFFICE

CERTIFICATE OF CORRECTION

PATENT NO. : 5,987,849
DATED : November 23, 1999
INVENTOR(S) : Donald E. Weder

It is certified that error appears in the above-identified patent and that said Letters Patent is hereby corrected as shown below:

Title page,
Item [57], ABSTRACT,
Line 5, delete the word "receiver" and substitute therefore the word -- receive --.

Column 2,
Line 41, delete the word "of" first occurrence.

Column 7,
Line 35, delete the word "of".

Column 8,
Line 18, delete the word "and" and substitute therefore the word -- an --.
Line 33, delete the word "All".

Column 10,
Line 26, delete the word "and" and substitute therefore the word -- an --.

Column 11,
Line 43, after the word, FIG. 6, add the word -- to --.

Column 13,
Line 49, delete the word "has" and substitute therefore the word -- have --.

Signed and Sealed this

Twenty-sixth Day of November, 2002

*Attest:*

*Attesting Officer*

JAMES E. ROGAN
*Director of the United States Patent and Trademark Office*